US005556230A

United States Patent [19]

Turk et al.

[11] Patent Number: 5,556,230

[45] Date of Patent: Sep. 17, 1996

[54] CONCRETE ARMOR UNIT FOR THE PROTECTION OF COASTAL, SHORE LINES AND HYDRAULIC STRUCTURES

[75] Inventors: George F. Turk; Jeffrey A. Melby, both of Vicksburg, Miss.

[73] Assignee: U.S. Army Corps of Engineers as represented by the Secretary of the Army, Washington, D.C.

[21] Appl. No.: 325,012

[22] Filed: Oct. 19, 1994

[51] Int. Cl.[6] ..... E02B 3/06

[52] U.S. Cl. ..... 405/29; 52/608; 405/16; 405/21; 405/30

[58] Field of Search ..... 405/29–35, 21, 405/16, 15, 19, 20; 446/85, 125; 52/608, 574; 404/41

[56] References Cited

U.S. PATENT DOCUMENTS

| | | | |
|---|---|---|---|
| 3,132,447 | 5/1964 | Hosbein | 52/574 X |
| 3,375,667 | 4/1968 | Hard | 405/16 |
| 3,822,499 | 7/1974 | De Vos | 405/29 X |
| 3,897,164 | 7/1975 | Dodino | 52/574 X |
| 4,172,680 | 10/1979 | Brown | 405/33 X |
| 4,341,489 | 7/1982 | Karnas | 405/35 |
| 4,594,023 | 6/1986 | O'Neill | 405/29 |
| 5,087,150 | 2/1992 | McCreary | 405/31 |
| 5,221,157 | 6/1993 | Prestedge | 405/31 X |

FOREIGN PATENT DOCUMENTS

| | | | |
|---|---|---|---|
| 0618477 | 8/1978 | U.S.S.R. | 405/33 |

*Primary Examiner*—Dennis L. Taylor
*Attorney, Agent, or Firm*—Luther A. Marsh

[57] ABSTRACT

The present invention describes a cylindrical armor unit for use in a revetment structure, herein referred to as Vatia Stone. These units are shaped for: i) optimal strength, positional stability and durability; ii) interlocking along all major axes; iii) flexible interlocking capability with each other for abrupt transitions in shorelines; and iv) natural aesthetic qualities. These qualities in combination provide a significant improvement over existing structures. The Vatia Stones are uniformly placed over an erosion controlled shoreline surface and have an optimal interlocking capability between individual units for maximum stabilization. Each unit has an upper and lower surface which can be shaped geometrically to fit the natural surroundings, e.g. look like natural stone as one example. The Vatia Stone combines superior hydraulic stability gained from interlocking of the individual units with the required aesthetic qualities of the surroundings which makes for a robust/durable visually appealing armor revetment structure.

18 Claims, 4 Drawing Sheets

CONCRETE ARMOR UNIT FOR THE PROTECTION OF COASTAL, SHORE LINES AND HYDRAULIC STRUCTURES

STATEMENT OF GOVERNMENT INTEREST

The invention described herein may be manufactured and used by or for the Government of the United States of America for governmental purposes without the payment of any royalties thereon.

FIELD OF THE INVENTION

This invention pertains to a revetment armor unit for integration into stable-breakwaters, revetments and jetties exposed to wave, currents and oscillations of seas, lakes, streams and artificial channels.

BACKGROUND OF THE INVENTION

Along shorelines of rivers, lakes, bays, estuaries, and ocean coastal shorelines, revetments are used to prevent erosion and loss of property. Many of these locations require aesthetically pleasing revetment structures as part of the evaluation criteria therefore. Traditional schemes of shoreline protection have used quarried stone for this purpose; but stone sources are either becoming depleted or mining of the required stone has become environmentally unattractive in many parts of the U.S. and throughout the world. Also, in many areas, quality stone is very expensive material to use for an erosion control structure. As a less expensive substitute, concrete armor units are frequently used.

Concrete armor units and erosion protection modules are made in a variety of shapes and sizes. Many such structurally complex breakwater armor units are illustrated and briefly described in a flyer entitled "Breakwater Armour Blocks" by the Hydraulics Research Station, Wallingford Oxfordshire, England. Moreover, U.S. Pat. Nos. 2,909,037; 3,176,468; 3,456,446; 3,614,866; 3,636,713; 3,759,043; 4,347,017; 4,594,023; 4,633,639; 5,122,015; 5,190,403; and U.S. Design Pat. Nos. 277,609 and 300,863 further illustrate known complex shaped armor units for shoreline revetments. Significant problems of these known armor units include: i) most are aesthetically unacceptable for certain shoreline areas due to their artificial man-made appearance with no provision for making them appear as natural rock; ii) they are generally more expensive to produce on a per-unit basis due to their irregular shapes and attendant longer multi-step manufacturing requirements; iii) many of these units, which form cooperatively a revetment structure, rely on frictional stability only, without the additional advantage of an interlocking nature between each of the units; iv) many blocks have interlocking in only one direction, but wave loading induces forces both along slope (up & down) and normal to slope (into and out of) so blocks must interlock along all major axes; v) some of the existing units offer very little hydraulic resistance to runup and overtopping and therefore offer little protection to property in the lee of the revetment structure and at transitions between the concrete armor and the underlying shoreline slope; vi) many of these armor units lack porosity in the armor layer producing high pressure differentials across the armor layer which contribute to instability of the armor layer; and vii) some of these complex designed armor units have slender members which are susceptible to structural failure.

An armor unit that teaches of a bar-like structure with interlocking design with a circular cross-section is U.S. Pat. No. 3,375,667 by Hard entitled "Revetment Structure and Units Therefore." This unit is intended for long axis horizontal placement along a shoreline where both frictional and interlocking stabilize the overall revetment structure. However, disadvantages of U.S. Pat. No. 3,375,667 include: i) the Hard unit being described and shown for only horizontal placement along the shore due to its inherent physical design which can easily be destabilized and cause catastrophic failure to a revetment structure, whereas the instant invention herein is preferably placed in a vertical position providing extraordinary stability; the instant invention also is very robust and has a keyed central section that offers additional stabilization of the units in a revetment structure; ii) the Hard unit has an inherent weak central rod structure that is prone to failure with time whereas the instant invention is of a robust monolithic construction; iii) the Hard unit will roll if one of the its units displaces out of position, whereas the instant invention has interlocking keyed sections that prevents roll; iv) the Hard unit has little porosity in an armor layer creating more runup and destabilizing forces; v) the Hard unit has no resistance to destabilization normal to slope, which is crucial due to wave-induced back pressures in this direction; and vi) the Hard unit lacks aesthetics for incorporation in a natural looking revetment structure whereas the instant invention has varied ways to make the end portions of the armor unit congruous with the natural surroundings.

SUMMARY OF THE INVENTION

The present invention describes a cylindrical armor unit for use in a revetment structure, herein referred to as Vatia Stone. These units are shaped for: i) optimal strength, positional stability and durability; ii) interlocking along all major axes; iii) flexible interlocking capability with each other for abrupt transitions in shorelines; and iv) natural aesthetic qualities. These qualities in combination provide a significant improvement over existing structures. The Vatia Stones are uniformly placed over an erosion controlled shoreline surface and have an optimal interlocking capability between individual units for maximum stabilization. Each unit has an upper and lower surface which can be shaped geometrically to fit the natural surroundings, e.g. look like natural stone as one example. The Vatia Stone combines superior hydraulic stability gained from interlocking of the individual units with the required aesthetic qualities of the surroundings which makes for a robust/durable visually appealing armor revetment structure.

OBJECTS OF THE INVENTION

Accordingly, several objects and advantages of the present invention are:

(a) To provide an armor revetment unit that provides a natural aesthetic appearance while providing a large mass-to-exposed surface ratio which allows for optimal stability as part of an armor revetment structure.

(b) To provide an armor revetment unit easily adaptable to differing shoreline slope conditions.

(c) To provide an armor revetment unit that is durable and not prone to failure.

(d) To provide an armor revetment unit that is inexpensive to construct.

(e) To provide an armor revetment structure composed of individual armor revetment units herein that has an overall natural aesthetic appearance that can appear as a natural rock type revetment structure.

Still further advantages will become apparent from consideration of the ensuing detailed description.

DETAILED DESCRIPTION

Figure 1A:
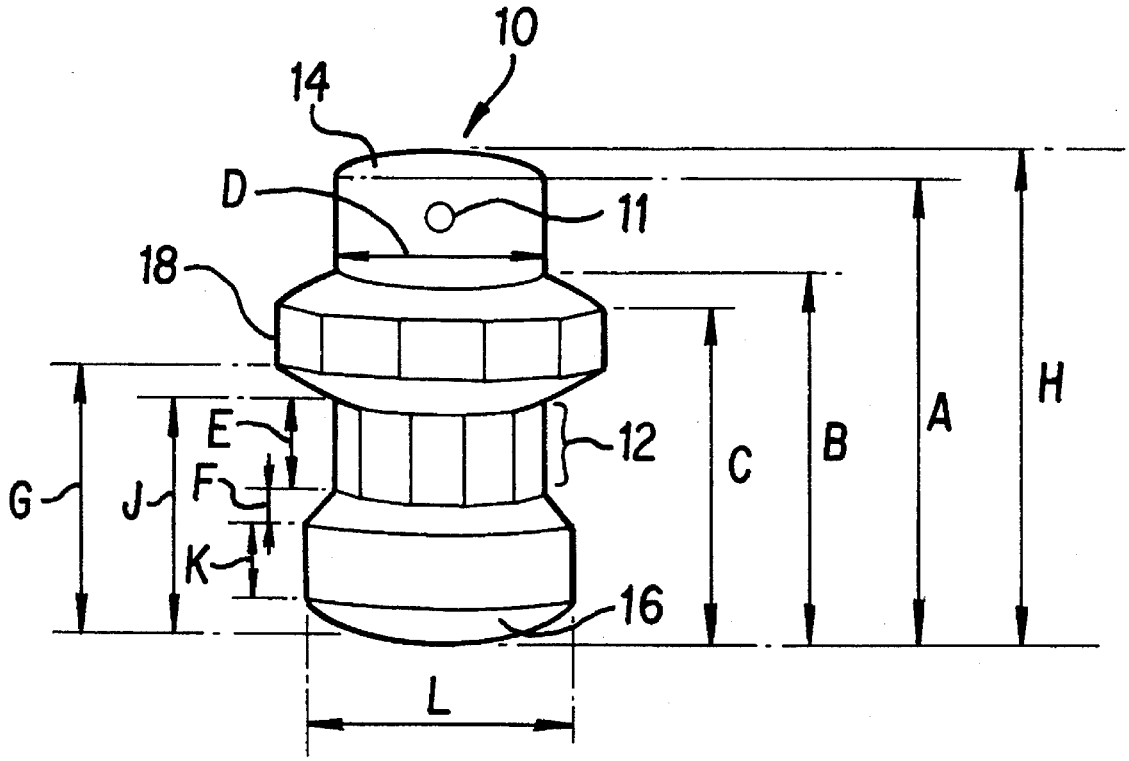
FIG. 1 illustrates the general shape of the Vatia Stone, i.e. the armor unit of the instant invention.
Figure 1B:
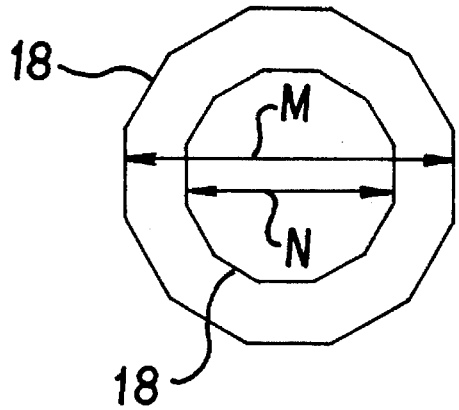
Figure 2:
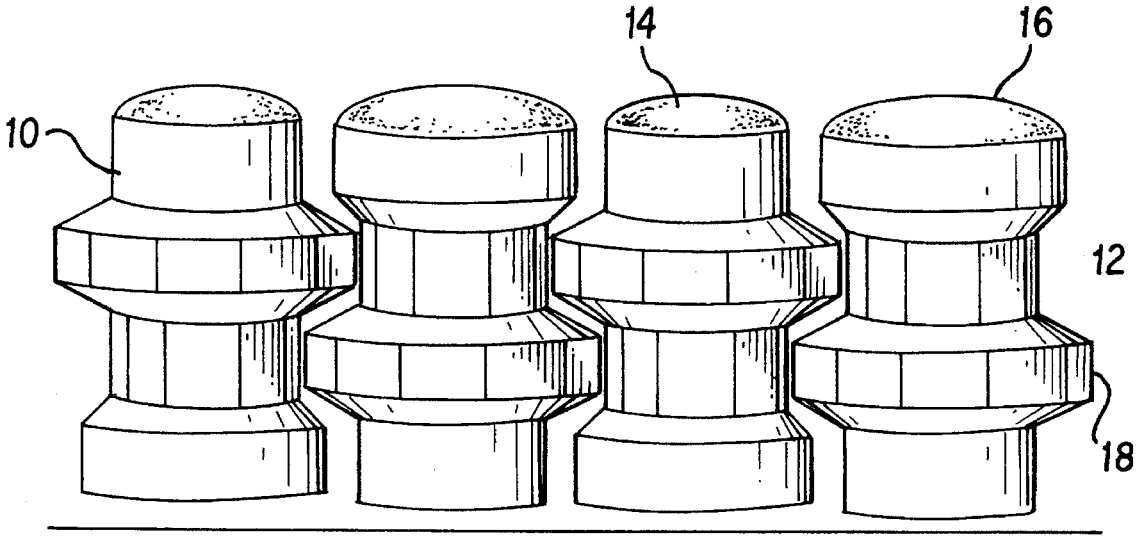
FIG. 2 illustrates how Vatia Stones interlock with each other.
Figure 5:
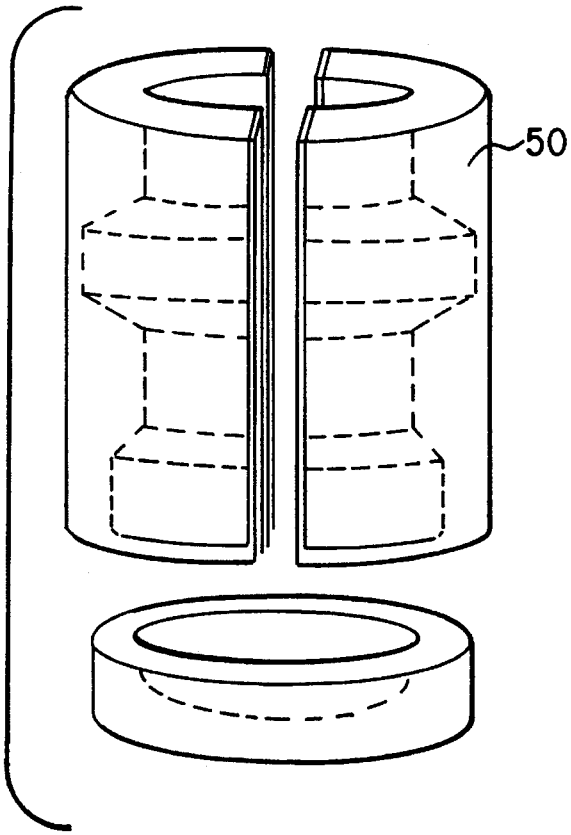
FIG. 5 illustrates a three piece cast for making Vatia Stones.

In FIG. 1, the general shape of the armor units, referred to herein as the Vatia Stone 10 is a solid circular cylinder with a symmetrical placed cutout 12 at mid section of its length. The cutout 12 is placed such that the two or more units will key together and interlock in alternating right-side-up with up-side-down orientation as shown in FIG. 2, thus requiring only a single multi-part cast 50 for making the Vatia Stone 10 as shown in FIG. 5. The small and large ends of the armor unit 10, when placed alternating top and bottom on a shoreline slope, provide a high degree of surface porosity (approximately 42%) which in turn provides for excellent wave or flow energy dissipation within an armor layer, which is comprised of multiple armor units 10, thus limiting runup and overtopping of the revetment structure. The small end 14 and large end 16 surfaces can be flat, concave, convex, or alternating flat, small-concave, or large-convex depending on the desired appearance and armor layer surface roughness required. Because the armor layer porosity is provided by inter-unit spacing, there is no need to make the units 10 hollow, which would structurally weaken the unit. Yet small holes 11 may be placed through the unit to: i) increase the hydraulic roughness and decrease the volume of concrete without significantly reducing the strength and ii) provide a method of pinning the armor units together using tie-rods between individual units for additional stability of a revetment structure. The aspect ratio, or ratio of the largest diameter to length dimensions, generally ranges between about 0.5 to 1.0 but can be greater than this to increase stability of an armor unit 10. The dimensionless numbers in relation to the height H of the armor unit 10 can range as follows to suit particular engineering requirements.

In particular, in view of FIG. 1, approximate acceptable ranges for dimensions of the armor unit: $0.8\ H<A<1.0\ H$; $0.55\ H<B<0.85\ H$; $0.4\ H<C<0.8\ H$; $0.2\ H<D<2.0\ H$; $0.1\ H<E<0.3\ H$; $0.01\ H<F<0.1\ H$; $0.35\ H<G<0.65\ H$; $0.30\ H<J<0.60\ H$; $0.10\ H<K<0.25\ H$; $0.40\ H<L<0.75\ H$; $0.5\ H<M<0.8\ H$; $0.30\ H<N<0.60\ H$.

Several Vatia Stone units 10 may be connected together in tandem in a stacked fashion to increase the armor layer stability if the shoreline transitions are susceptible to erosion. While the surface porosity and the visual appearance are integral and inseparable, the lateral cutout 12 are all subsurface and out of sight of the armor layer's top surface. This separation of the interlocking and the visual surface which is either the small end 14 or large end 16 of each armor unit 10 allows these end surfaces to be cast in a multitude of shapes to achieve any number of desirable appearances, while maintaining the surface porosity. As stated above, the exposed visible end surfaces 14 and 16 of the units 10 can be cast using a three-piece mold 50 as shown in FIG. 5. The end portion of the mold can be formed using indigenous stone as a die so that the armor layers small end 14 and large end 16 will appear to be composed of stones. Also, the form surface of the mold 50 can be coated with a cement retarder admixture during casting to increase the surface roughness for both improved stability and enhanced natural appearance. A coloring agent can be added to the concrete to also enhance the appearance of the Vatia Stone to blend in with the surroundings. Any subset or combination of these visual surface modifications may be used to create the desired appearance.

The general shape of the Vatia Stone units 10 are cylindrical but the keyed portions 18 of the armor unit which are the almost flat locking surfaces between the units can be cast into the shape of a regular polygon to prohibit the tendency of the individual units to rock as shown in FIGS. 1 & 2. This subsurface shaping can improve stability without altering the exterior appearance or the complexity of the casting process. The polygonal shape can be any number of sides; but with too few sides the corners will tend to spall and with too many sides the advantages of the polygonal shape will be lost. The number of sides should therefore range between 8 and 12.

Figure 3:
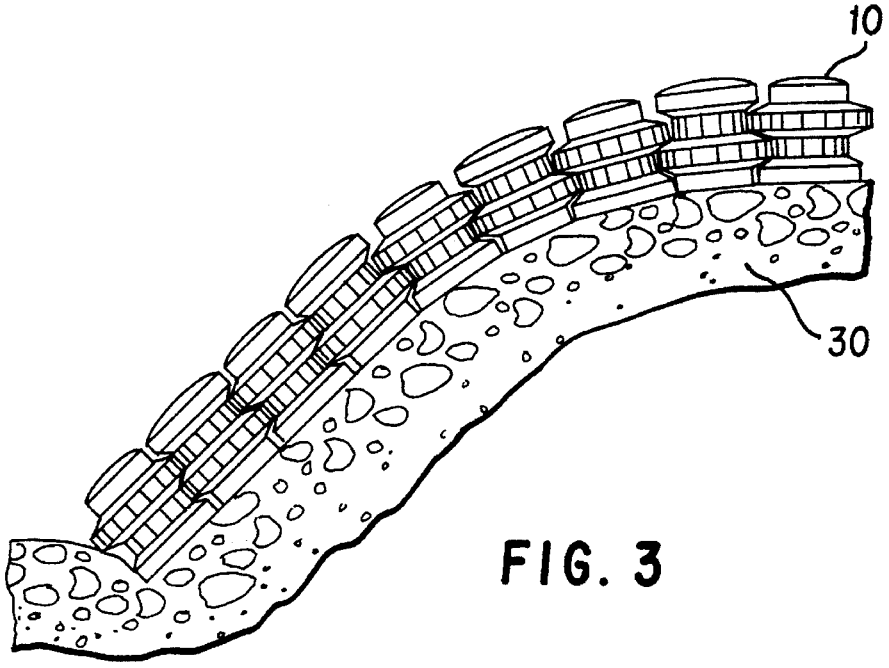
FIG. 3 illustrates how Vatia Stones would be placed over a curved surface.
Figure 4:
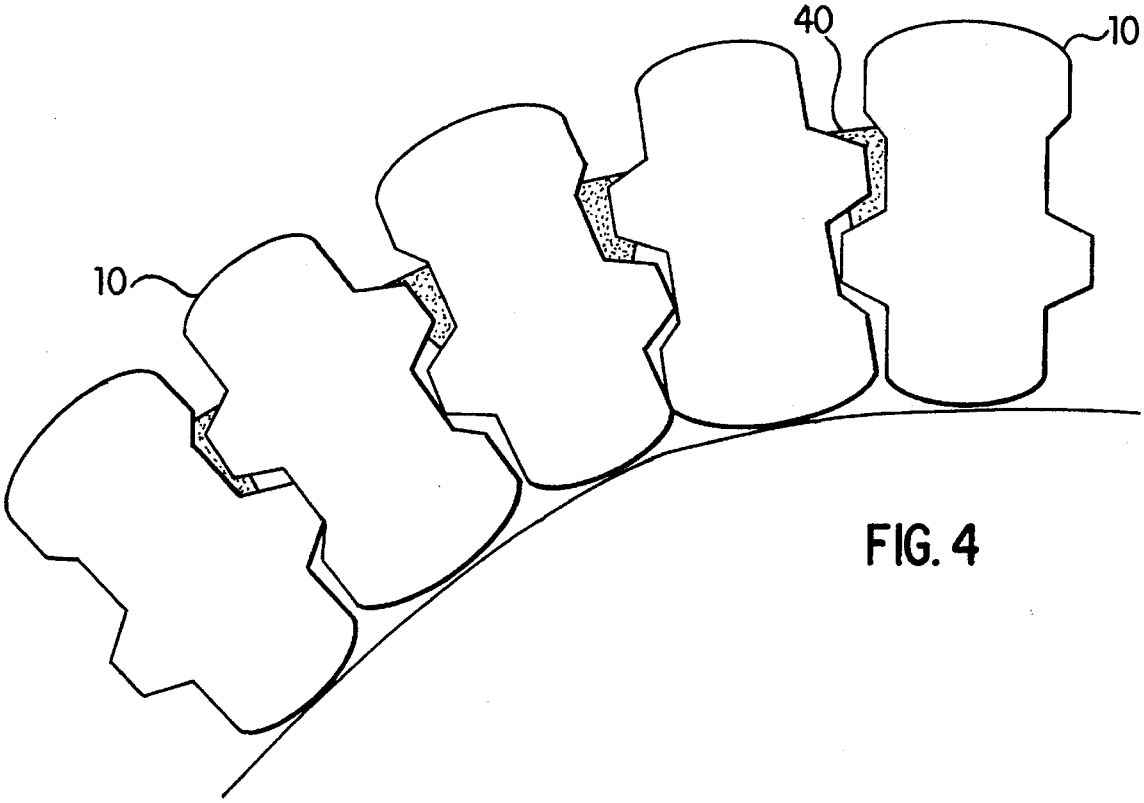
FIG. 4 illustrates how Vatia Stones would be placed over a curved surface and locked with wedge spacers.

The keyed portions 18 of the unit 10 have angled surfaces so that the units will wedge together during the armor layer construction. The shape of the keyed joint is such that the spacing between the upper and lower surfaces of each keyed joint 18 is dimensioned at approximately one-tenth of the keyed width. The keyed joint 18 geometry allows maximum interlocking between the units 10 to be maintained when the underlayer is somewhat uneven and irregularly sloped. The shape of the keyed joint 18 allows the armor layer to be 'bent' over the crest or around transitions of a shoreline surface by tilting the individual units 10 a small amount in the region of a bend 30 as shown in FIG. 3. The rigidity of the armor layer can be maintained with spacers 40 in the form of a precast wedges or geotextile concrete filled bags between the units as shown in FIG. 4. These spacers 40 can also be used to repair an armor layer that has loosened. The spacers 40 should be kept small so that they do not reduce the armor layer porosity.

The limited porosity of the subsurface portion of the armor layer allows the use of much smaller and generally cheaper underlayer material than existing units. Also, a geotextile-covered surface or gabion-style cage may be used as an underlayer to allow placement of the armor units 10 directly on very fine underlayer. The combination of high surface porosity and sufficient subsurface voids prevents the formation of high pressure differentials across the armor layer, which can cause instability in other armor layer types. This is particularly true of armor layers with little porosity when constructed on low-porosity underlayers.

The shape of the Vatia Stone 10 is such that, for a common application using 500 to 1000 pound units, the forms can be constructed in three or four pieces, with two-piece sides attached together and placed directly on the ground or directly attached to a shaped form bottom. The shaped form top can be attached to the form sides. The forms can be constructed of plastic, fiberglass or steel depending on which is most economical. Mold 50 form pieces are shown in FIG. 5.

Figure 6:
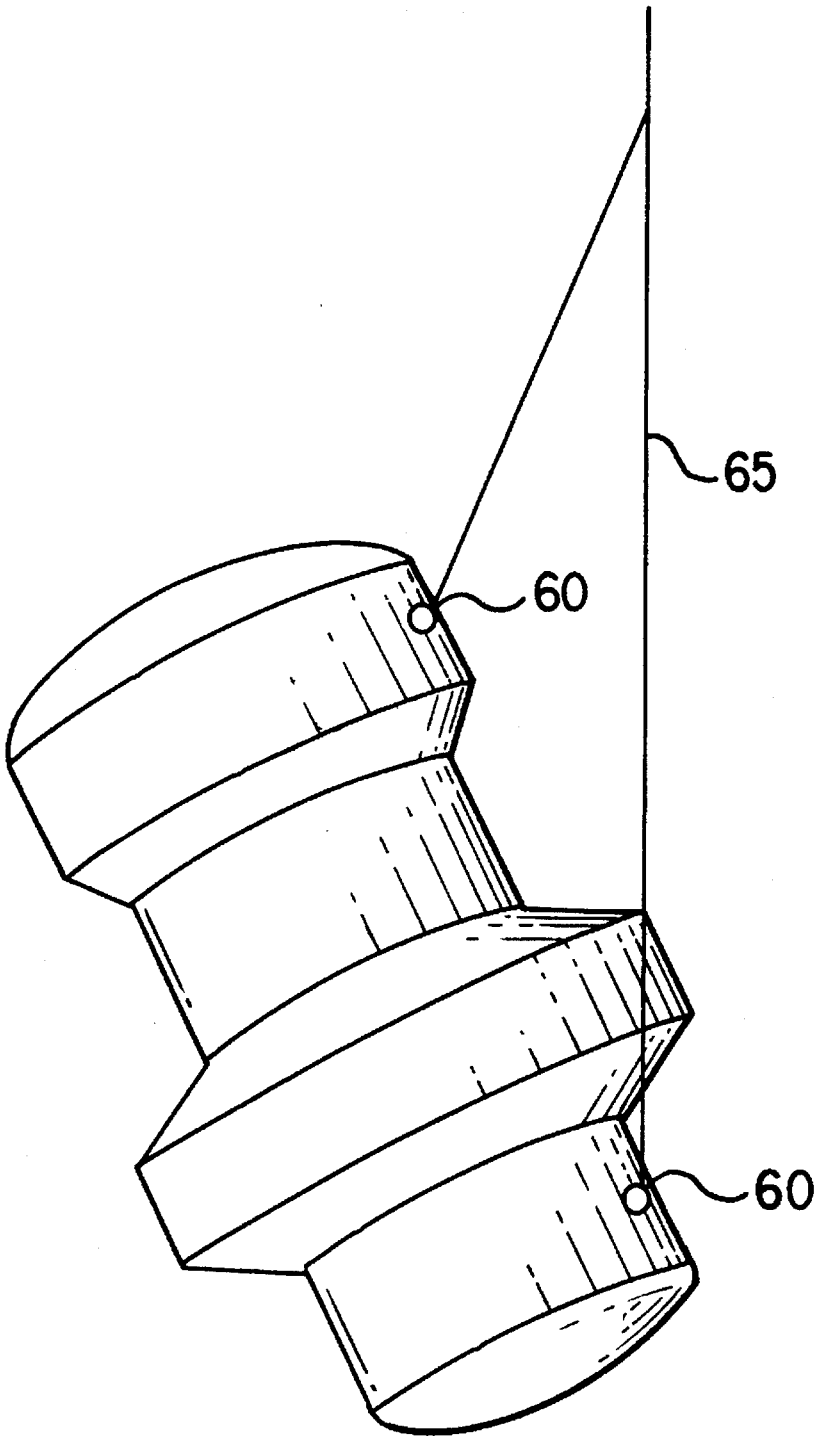
FIG. 6 illustrates Vatia Stones with picking eyes for slinging the Vatia Stones into position at the shoreline.

To aid in the placement of the units, recessed pins can be positioned in either the sides or top of each unit. The pins provide pick points 60 for the picking cable 65. This is shown in FIG. 6. The units can also be placed using slings wrapped around the center of the unit.

Although the description above contains many specificities, these should not be construed as limiting the scope of this invention as set forth in the appended claims, but as merely providing illustration of the presently preferred embodiment of this invention. Variations to the preferred design include the armor unit 10 having multiple grooved cutout portions 12 for interlocking of the units, the angle of the normal to the orientations of the planes of the keyed portions 18 can be varied with respect to the axis of the unit 10, but two symmetrical matching molds 50 would be required versus a single mold as discussed above.

We claim:

1. An armor revetment unit for breakwater, jetties, and the like, the unit comprising:

a monolithic cylindrical structure made up of multiple coaxial aligned cylindrical subportions of varying diameter having at least one uniform circumferential sidewall groove cutout along the cylindrical structure's length which forms a means for interlocking a sidewall of substantially similar armor revetment units for placement along a shoreline, each sidewall groove cutout is defined by a quadrangle surface in cross-section, the quadrangle surface lies within a longitudinal cross-section containing an axis of the cylindrical structure;

the cylindrical structure has two end surfaces, a large end surface and a small end surface where the large end surface is larger in diameter than the small end surface;

each of the two end surfaces are juxtaposed with one of the cylindrical subportions; and in which the means for interlocking multiple armor revetment units further comprises keyed flat surfaces that forms a polygon as defined by a planar cross-section normal to a longitudinal axis of the cylindrical structure at: i) the inner portion of the uniformly circumferential groove and ii) on at least one of the cylindrical subportions, whereby stability is enhanced due to more restriction in motion by interlocking normal to the shoreline's slope the substantially similar armor revetment units for placement along the shoreline.

2. The armor revetment unit of claim 1 in which an aspect ratio defined as the the largest diameter of one of the cylindrical subportions to overall length of the cylindrical structure is in a range from about 0.5 to 1.0.

3. The armor revetment unit of claim 1 in which the two end surfaces are substantially oblate.

4. The armor revetment unit of claim 3 wherein the end surfaces are flat.

5. The armor revetment unit of claim 3 wherein the end surfaces are substantially concave shaped.

6. The armor revetment unit of claim 3 wherein the end surfaces are substantially convex shaped.

7. The armor revetment unit of claim 3 wherein the end surfaces are substantially small concave shaped.

8. The armor revetment unit of claim 1 in which the two end surfaces are irregularly shaped like a natural stone.

9. The armor revetment unit of claim 1 in which there is only a single groove cutout wherein the annular groove cutout that is substantially defined by the quadrangle cross-section has one side of the quadrangle form part of the sidewall and is parallel to the axis of the the cylindrical structure.

10. The armor revetment unit of claim 1 in further include pick points.

11. An armor revetment structure comprising a plurality of armor revetment units, each of the units comprising a monolithic cylindrical structure made from multiple coaxially aligned cylindrical subportions of varying diameter having at least one uniform sidewall circumferential groove cutout along the cylindrical structure's length which is a means for interlocking sidewalls of substantially similar armor revetment units when placed along a shoreline, each sidewall groove cutout is defined by a quadrangle surface in cross-section, the quadrangle surface in cross-section lies within a longitudinal plane containing an axis of the cylindrical structure, the cylindrical structure has two end surfaces, a large end surface and a small end surface where the large end surface is larger in diameter than the small end surface, each of the two end surfaces are juxtaposed with one of the cylindrical subportions;

the structure formed by interlocking each of the units so that the side walls of each unit between the groove cutouts in each unit interfits in the groove cutouts of adjacent units; and the structure covering corresponding layers of foundation.

12. The armor revetment structure of claim 11 in which the armor unit has only one groove cutout wherein the groove cutout is substantially defined by a quadrangle in cross-section which has one side form part of the sidewall which is parallel to the axis of the the cylindrical structure.

13. The armor revetment structure of claim 11 in which spacers are inserted between the armor units for additional stability.

14. An armor revetment unit for breakwater, jetties, and the like along shorelines, the unit is a monolithic cylindrical type structure built up by a series of solid regular forms coaxially aligned comprising:

a bottom cylinder that interfaces with a large end base of a first conical frustum;

a first mid-section cylinder whose bottom surface interfaces with a small end base of the first conical frustum;

a small end base of a second conical frustum interfaces with the mid-section cylinder;

a second mid-section cylinder interfaces with a large end base of the second conical frustum;

a large end base of a third conical frustum interfaces with the second mid-section cylinder; and a small end base of the third conical frustum interfaces with a top cylinder;

wherein the bottom cylinder has a smaller diameter than the top cylinder.

15. The armor revetment unit of claim 14 wherein the first mid-section cylinder and the second mid-section cylinder are prismatoids that are a means for interlocking substantially similar armor revetment units that have mating keyed flat surface whereby stability is enhanced due to more restriction in motion by interlocking normal to the shoreline's slope the substantially similar armor revetment units for placement along the shoreline.

16. The armor revetment unit of claim 14 in which an aspect ratio defined as the the largest diameter of one of the cylinders to overall length of the monolithic cylindrical structure is in a range from about 0.5 to 1.0.

17. The armor revetment unit of claim 14 in which the top and bottom cylinders has external top and bottom surfaces respectively are made to have an appearance of natural stone.

18. The armor revetment unit of claim 14 in which the monolithic cylindrical structure has a hole through the axial center of the structure at a sidewall location which is a means for placement of a tie-bar there through whereby additional stability can be provided to a revetment structure.

* * * * *